US010082364B2

(12) United States Patent
Hinson, Jr.

(10) Patent No.: US 10,082,364 B2
(45) Date of Patent: Sep. 25, 2018

(54) SHOTGUN FITTER

(71) Applicant: Lanny Dale Hinson, Jr., Hampshire, TN (US)

(72) Inventor: Lanny Dale Hinson, Jr., Hampshire, TN (US)

( * ) Notice: Subject to any disclaimer, the term of this patent is extended or adjusted under 35 U.S.C. 154(b) by 363 days.

(21) Appl. No.: 14/937,064

(22) Filed: Nov. 10, 2015

(65) Prior Publication Data

US 2017/0131063 A1 May 11, 2017

(51) Int. Cl.
*F41A 15/00* (2006.01)
*F41C 27/00* (2006.01)

(52) U.S. Cl.
CPC ..... *F41C 27/00* (2013.01)

(58) Field of Classification Search
CPC ..... F41C 27/00
USPC ..... 42/90
See application file for complete search history.

(56) References Cited

U.S. PATENT DOCUMENTS 18,294 A * 9/1857 Newton ..... F16B 15/00 411/452
895,080 A * 8/1908 Eisenreich ..... F16B 15/06 411/452
1,134,160 A * 4/1915 Russell ..... F16B 15/06 411/451.3
1,277,932 A * 9/1918 Hollifield ..... F41G 3/26 434/19
1,835,938 A * 12/1931 Ewen ..... F41G 1/473 42/144
2,014,746 A * 9/1935 Robergel ..... B21G 3/005 411/452
2,056,469 A * 10/1936 King ..... F41G 1/473 42/140
2,285,281 A * 6/1942 Johnson ..... E21B 17/006 33/286
2,482,909 A * 9/1949 Hertz ..... B25D 1/06 279/128
2,498,329 A * 2/1950 Barnes ..... F41G 1/473 42/111
2,510,413 A * 6/1950 Paige ..... F41G 3/26 434/19
2,519,220 A * 8/1950 Bentley ..... F41G 1/473 42/141
2,553,540 A * 5/1951 Beckerman ..... F41G 1/14 356/247
2,585,345 A * 2/1952 Procos ..... F41G 1/425 42/139
2,904,888 A * 9/1959 Niesp ..... F41G 1/473 42/141
3,028,674 A * 4/1962 Luebkeman ..... F41G 1/425 42/144
3,178,824 A * 4/1965 Callihoe ..... F41G 1/473 42/141
3,190,002 A * 6/1965 Bliss ..... F41G 1/01 33/228
3,744,133 A * 7/1973 Fukushima ..... F41G 1/54 33/297

(Continued)

*Primary Examiner* — Michelle Clement

(57) ABSTRACT

A tool used in fitting a shotgun to a user can be a block and an elongated cross shaped portion extending therefrom. The block has a back side and has a front side from which the cross shaped portion extends at a substantially right angle. The cross shaped portion divides an aligning portion of the flat surface into four regions wherein each of the four regions has an identifying attribute. All the identifying attributes are only seen when viewed from a position aligned longitudinally with the elongated cross shaped portion.

20 Claims, 2 Drawing Sheets

(56) References Cited

U.S. PATENT DOCUMENTS 3,908,282 A * 9/1975 Steffan ..... F41G 1/54 33/286
3,911,607 A * 10/1975 Luebkeman ..... F41G 1/027 42/129
3,912,400 A * 10/1975 Luebkeman ..... F41G 1/027 356/247
3,920,335 A * 11/1975 Seehase ..... G01B 11/27 33/286
3,960,460 A * 6/1976 Fischer ..... A63H 19/36 403/292
3,974,586 A * 8/1976 Kappner ..... F41G 1/00 42/111
4,000,574 A * 1/1977 Grant ..... F41A 21/24 42/112
4,008,536 A * 2/1977 Adams ..... F41G 1/00 42/112
4,017,995 A * 4/1977 Hughes, Jr. ..... F41G 1/26 42/136
4,070,763 A * 1/1978 Carts, Jr. ..... F41G 1/32 250/467.1
4,090,305 A * 5/1978 Cassidy ..... F41G 1/54 33/391
4,095,347 A * 6/1978 Steffan ..... F41G 1/38 33/295
4,112,583 A * 9/1978 Castilla ..... F41G 1/473 42/141
4,117,617 A * 10/1978 Linde ..... F41G 1/16 42/112
4,381,150 A * 4/1983 Curtis ..... G01B 11/27 356/153
4,614,039 A * 9/1986 Kafri ..... F41G 1/34 42/119
4,616,421 A * 10/1986 Forsen ..... F41G 1/12 42/122
4,624,056 A * 11/1986 Moore ..... F41G 1/545 33/286
4,679,344 A * 7/1987 Jolly ..... F41G 1/32 42/112
4,713,889 A * 12/1987 Santiago ..... F41C 33/0227 224/246
4,733,490 A * 3/1988 Mulawski ..... F41G 1/545 42/134
4,745,686 A * 5/1988 Willis ..... F41G 1/473 42/136
4,745,698 A * 5/1988 Schwulst ..... F41G 1/02 42/131
4,755,091 A * 7/1988 Potucek ..... F16B 15/00 411/452
4,790,075 A * 12/1988 Howard, Sr. ..... F41G 1/16 42/130
4,823,978 A * 4/1989 Pufpaff ..... E04F 19/00 220/787
4,973,211 A * 11/1990 Potucek ..... F16B 15/00 411/452
4,976,038 A * 12/1990 Nattrass ..... F41C 23/14 42/111
4,979,859 A * 12/1990 Castleberry ..... A47G 27/0462 16/16
4,993,158 A * 2/1991 Santiago ..... F41G 1/32 42/135
5,143,501 A * 9/1992 Leistner ..... F16B 15/08 206/343
5,396,708 A * 3/1995 Whitley ..... F41G 3/323 279/2.02
5,442,860 A * 8/1995 Palmer ..... F41G 1/545 33/286
5,471,777 A * 12/1995 McDonald ..... F41G 1/345 362/110
D376,406 S * 12/1996 Rosen ..... D22/108
5,769,280 A * 6/1998 Ehresmann ..... A47G 23/0241 222/108
6,176,019 B1 * 1/2001 Frear, Jr. ..... F41G 3/323 42/120
6,321,479 B1 * 11/2001 Sheehan ..... F41G 1/00 42/111
6,336,285 B1 * 1/2002 Baumer ..... F41G 1/00 42/113
6,499,247 B1 * 12/2002 Peterson ..... F41G 1/54 42/116
6,598,331 B1 * 7/2003 Thibodeaux ..... F41G 1/41 42/111
6,604,315 B1 * 8/2003 Smith ..... F41G 1/027 42/111
6,622,413 B1 * 9/2003 Bickett ..... F41G 1/14 42/112
6,804,908 B1 * 10/2004 Hanson ..... F41G 1/52 42/111
6,862,833 B1 * 3/2005 Gurtner ..... F41G 1/545 42/120
7,062,874 B1 * 6/2006 Smith ..... F41A 21/325 42/1.01
7,100,319 B2 * 9/2006 Paige ..... F41G 1/54 33/286
7,313,885 B1 * 1/2008 Looney ..... F41G 1/545 33/645
7,328,531 B2 * 2/2008 Dietz ..... F41G 1/473 42/133
7,377,068 B2 * 5/2008 Musser ..... F41G 1/54 42/111
7,540,108 B2 * 6/2009 Irwin ..... F41G 1/16 42/112
7,644,531 B2 * 1/2010 Musser ..... F41A 33/00 42/111
7,665,218 B1 * 2/2010 Pinto ..... F41G 3/323 33/282
7,670,093 B2 * 3/2010 Reynolds ..... F16B 15/00 411/451.4
7,707,761 B2 * 5/2010 Bojalad ..... F41A 21/08 42/76.01
7,721,479 B2 * 5/2010 Schulst ..... F41G 1/08 42/111
7,752,798 B2 * 7/2010 Mayerle ..... F41G 1/41 42/118
7,882,655 B1 * 2/2011 Nesseth ..... F41G 1/12 42/111
8,104,186 B2 * 1/2012 Raschella ..... G01C 15/004 33/265
8,161,675 B2 * 4/2012 Sne ..... F41G 1/027 42/111
8,209,896 B1 * 7/2012 Cashwell ..... F41A 23/18 206/317
8,245,433 B1 * 8/2012 Smith ..... F41G 1/01 42/112
8,438,775 B2 * 5/2013 Howe ..... F41G 1/01 42/111
8,561,341 B1 * 10/2013 Dihlmann ..... F41G 1/545 42/120
8,572,884 B1 * 11/2013 Saur ..... F41A 11/00 269/909
8,745,914 B2 * 6/2014 Schmidt ..... F41G 11/001 42/106
8,764,188 B2 * 7/2014 Tabor ..... A61B 3/08 351/201
8,800,154 B2 * 8/2014 Schmidt ..... F41G 1/545 33/286
8,960,542 B2 * 2/2015 Jaroh ..... F41G 3/165 235/400
8,978,287 B1 * 3/2015 Riley ..... F41G 1/473 42/141
9,448,038 B2 * 9/2016 Palmer ..... F41G 1/38
9,709,360 B2 * 7/2017 Albertini ..... F41G 1/473
2004/0076928 A1 * 4/2004 Renntoft ..... F41A 33/02 434/21
2004/0200116 A1 * 10/2004 Gussalli Beretta ..... F41G 1/425 42/112
2005/0072035 A1 * 4/2005 McClimond ..... F41G 1/08 42/133

(56) References Cited

U.S. PATENT DOCUMENTS

2005/0086848 A1* 4/2005 Dietz ..... F41G 1/473 42/130
2007/0113460 A1* 5/2007 Potterfield ..... F41G 1/44 42/120
2007/0204502 A1* 9/2007 Popikow ..... F41G 1/425 42/112
2007/0240357 A1* 10/2007 Musser ..... F41G 1/54 42/134
2008/0104875 A1* 5/2008 Mayerle ..... F41G 1/40 42/118
2010/0269395 A1* 10/2010 Iversen ..... F41C 23/14 42/112
2013/0174465 A1* 7/2013 Martinez Martinez ..... F41G 1/473 42/139
2013/0283660 A1* 10/2013 Matthews ..... F41G 1/30 42/113
2013/0344461 A1* 12/2013 Tello ..... F41G 3/2633 434/21
2014/0215887 A1* 8/2014 Luckey ..... F41G 11/003 42/90
2015/0027027 A1* 1/2015 Frederick ..... F41G 11/004 42/141
2015/0121742 A1* 5/2015 Wilkinson ..... F41A 11/00 42/108
2015/0285590 A1* 10/2015 Law ..... F41G 1/16 42/111
2016/0040960 A1* 2/2016 Palmer ..... F41G 1/38 42/120
2016/0054098 A1* 2/2016 Monaghan ..... F41G 1/10 42/141
2016/0252323 A1* 9/2016 Gomez ..... F41G 1/545 42/108

* cited by examiner

SHOTGUN FITTER

CROSS-REFERENCE TO RELATED APPLICATIONS

Not Applicable

STATEMENT REGARDING FEDERALLY SPONSORED RESEARCH

Not Applicable

FIELD OF THE INVENTION

This invention relates to a device used in customizing the fit of a shotgun.

BACKGROUND OF THE INVENTION

Proper shotgun fit can be one of the most important elements in becoming a highly successful shooter. This is true in the field and/or on the range. For young shooters achieving this fit can be especially problematic as it is often more difficult for young shooters to describe what they are seeing during the fitting procedure. Proper fit can help assure that the shooter is looking correctly down the length of the barrel. A tool that can improve results and improve the time it takes to properly fit a shotgun to the individual shooter is desirable.

The instant invention as disclosed within this application, provides a tool that fills this need. The art referred to and/or described within this application is not intended to constitute an admission that any patent, publication or other information referred to herein is "prior art" with respect to this invention. In addition, this section should not be construed to mean that a thorough search has been made or that no other pertinent information as defined in 37 C.F.R. § 1.56(a) exists.

All US patents and applications and all other published documents mentioned anywhere in this application are incorporated herein by reference in their entirety.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

BRIEF SUMMARY OF THE INVENTION

Among other things, this application presents a concept of a tool that can be used for a shotgun though there are applications in with other firearms.

In at least one embodiment of the invention, the tool can comprise a block and an elongated cross shaped portion extending therefrom. The block can have a back side and can have a front side from which the cross shaped portion extends at a substantially right angle. The cross shaped portion can divide an aligning portion of the flat surface into four regions in which each of the four regions has an identifying attribute. In some embodiments, all the identifying attributes are only seen when viewed from a position aligned longitudinally with the elongated cross shaped portion.

In at least one embodiment of the invention, the aligning portion can be substantially elliptical.

In at least one embodiment of the invention, the identifying attributes can be colors.

In at least one embodiment of the invention, each of the identifying attributes can be a different color.

In at least one embodiment of the invention, the attributes can be lights.

In at least one embodiment of the invention, the lights can be formed using optical fibers.

In at least one embodiment of the invention, the block can be a casing wherein the backside is opposite the front side and the backside has a light allowing portion that allows light to enter inside the casing. The identifying attributes can be activated by the light entering the inside of the casing.

In at least one embodiment of the invention, the optical fibers within the casing can carry light to the identifying attributes.

In at least one embodiment of the invention, the light allowing portion can be constructed from a material selected from the group consisting essentially of glass, plastic, paper, and any combination thereof.

In at least one embodiment of the invention, the elongated cross shaped portion can be constructed and arranged of a material that is non-reflective.

In at least one embodiment of the invention, the tool can have attachment means used to help secure the tool to the shotgun.

In at least one embodiment of the invention, the attachment means can be a magnetic portion on the block that affixes to the end of the barrel.

In at least one embodiment of the invention, the attachment means can be a mechanical device selected from the group consisting essentially of clips, fittings, bands, and any combination thereof.

In at least one embodiment of the invention, the block is constructed from a material selected from the group consisting essentially of glass, plastic, wood, metal, cement board, and any combination thereof.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

BRIEF DESCRIPTION OF THE SEVERAL VIEWS OF THE DRAWING(S)

A description of the invention is hereafter described with specific reference being made to the drawing.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

Figure 1:
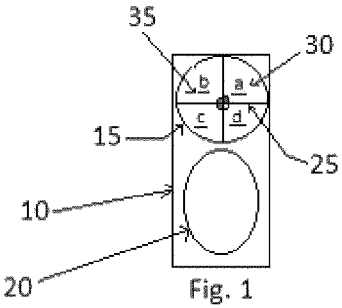
FIG. 1 is a front view of an embodied shotgun fitting tool.

In FIG. 1 a front view of the front side of the shotgun fitting tool 10 is shown. As illustrated, the tool 10 has an aligning portion 15 and an attachment area 20. The aligning portion 15 can have an elongated cross shaped portion 25 extending therefrom. This is perhaps better seen in FIG. 2. Looking again at FIG. 1, the cross shaped portion 25 divides the aligning portion 15 into four quadrants 30*a*, 30*b*, 30*c*, and 30*d*. Within each quadrant are identifying attributes 35*a*, 35*b*, 35*c*, and 35*d*. The identifying attributes can be a wide variety of markings and/or lights. The identifying attributes can be different from one another or two or more can be the same. In some embodiments colors are used to differentiate each of the identifying attributes. In some embodiments lights are used and in some embodiments lights of different colors are used.

In using the tool, the tool 10 is placed at the end of a barrel and centered on the vent rib. The elongated portion 25 extends longitudinally along the barrel along the vent rib. A shooter can comfortably hold the gun against his shoulder and cheek and could look down the length of the elongated cross shaped portion 25. If the shooter sees a view very similar to that of the aligning portion 15 of FIG. 1 then the shotgun may well be fitted to the shooter. The shooter in this illustrated embodiment would see four quadrants 30*a-d* and distinct identifying attributes (35*a* being red, 35*b* green, 35*c* blue, and 35*d* yellow). This would indicate that the shotgun is fitted to that shooter. Adjustments would need to be made if one or more of the identifying attributes are not seen when looking down the length of the elongated cross shaped portion 25.

Figure 2:
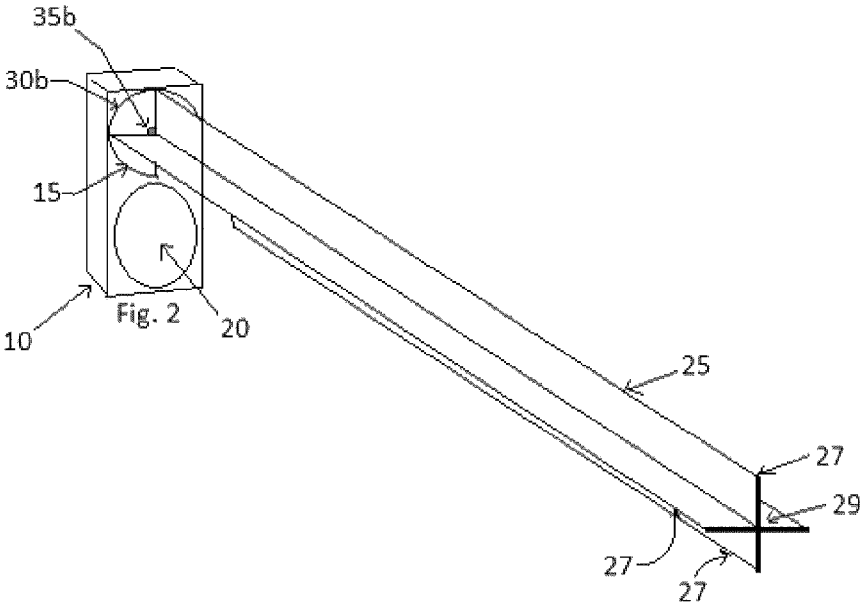
FIG. 2 is a perspective view of an embodied shotgun fitting tool.

The tool 10 can also include an attachment area 20 as shown FIGS. 1 and 2. As shown here the attachment area is a magnetic surface. In some embodiments a hollowed out portion can be used and in other embodiments bands, rings, and/or clips can be used.

In FIG. 2 the elongated nature of the cross shaped portion 25 is shown. The cross shaped portion is elongated in order to better determine whether the shooter is truly fitting the gun. The elongated portion 25 can be ¼-3 inches long for some embodiments or purposes. In some embodiments the elongated portion 25 can be 3-10 inches long and in some embodiments 10-20 inches long or longer. The ribs 27 of the elongated portion 25 can be about 5/16" wide extending from their intersection 29. In some embodiments their lengths are not uniform. In some embodiments the lower rib might be shorter than the other ribs.

Figure 3:
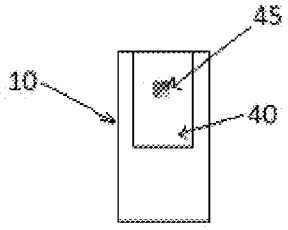
FIG. 3 is a rear view of an embodied shotgun fitting tool.

The back side of the tool 10 is shown in FIG. 3. As shown here, the tool 10 includes a light allowing portion 40 that allows light to enter the inside of the tool 10. The light allowing portion 40 can be clear in some embodiments and opaque in other embodiments as long as light is allowed into the tool 10. The light allowing portion can be constructed from a material selected from the group consisting essentially of glass, plastic, paper, and any combination thereof. Light entering the tool 10 can strike fiber optic rods or lines 45 and have the light transmitted to the identifying attributes 35. In some embodiments the light alone without the fiber optic rods 45 can be enough to lighten the identifying attributes 35; in some embodiments, reflective material can be placed on the inside of the tool to accomplish this.

It should be noted that the attributes 35 can also be lit through the use of batteries within the tool in some embodiments.

Figure 4:
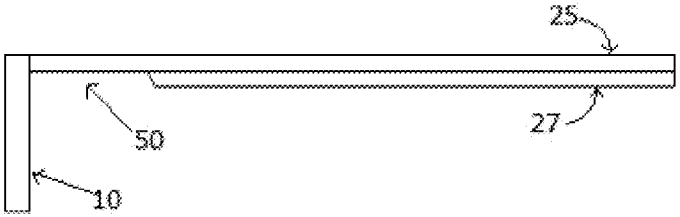
FIG. 4 is a side view of an embodied shotgun fitting tool.

As shown in FIG. 4, a bead groove 50 is cut out of the lower rib 27 of the elongated portion 25. The groove can provide space for the bead on a shotgun in order for the elongated portion 25 to extend evenly along the vent rib. The casing of the tool 10 can be constructed from a material selected from the group consisting essentially of glass, plastic, rubber, wood, metal, cement board, and any combination thereof.

For the purposes of this disclosure, like reference numerals in the figures shall refer to like features unless otherwise indicated.

The above disclosure is intended to be illustrative and not exhaustive. This description can suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

Further, the particular features presented can be combined with each other in other manners within the scope of the invention such that the invention should be recognized as also specifically directed to other embodiments having any other possible combination of the features listed above.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A tool used in fitting a shotgun to a user, the tool comprising a block and an elongated cross shaped portion extending therefrom, the block having a back side and having a front side from which the cross shaped portion extends at a substantially right angle, the cross shaped portion dividing an aligning portion of the flat surface into four regions, each of the four regions having a unique identifying attribute, all the identifying attributes are only seen when viewed from a position aligned longitudinally with the elongated cross shaped portion.

2. The tool of claim 1 wherein the aligning portion of the flat portion is substantially elliptical.

3. The tool of claim 1 wherein the identifying attributes are colors.

4. The tool of claim 3 wherein each of the identifying attributes is a different color.

5. The tool of claim 1 wherein the attributes are lights.

6. The tool of claim 5 wherein the lights are formed using optical fibers.

7. The tool of claim 5 wherein the block is a casing wherein the backside is opposite the front side and the backside has a light allowing portion that allows light to enter inside the casing, the identifying attributes being activated by the light entering the inside of the casing.

8. The tool of claim 7 wherein optical fibers within the casing carry light to the identifying attributes.

9. The tool of claim 1 wherein the light allowing portion is constructed from a material selected from the group consisting essentially of glass, plastic, paper, and any combination thereof.

10. The tool of claim 1 wherein the elongated cross shaped portion is constructed and arranged of a material that is non-reflective.

11. The tool of claim 1 having attachment means, the attachment means used to help secure the tool to the shotgun, the attachment means being a mechanical device selected from the group consisting essentially of clips, fittings, bands, and any combination thereof.

12. The tool of claim 1 having attachment means, the attachment means used to help secure the tool to the shotgun, the attachment means is a magnetic portion on the block that affixes to the end of the barrel.

13. A shotgun and a tool used in fitting a shotgun to a user, the tool having attachment means to help secure the tool to the shotgun, the tool comprising a block and an elongated cross shaped portion extending therefrom, the block having a back side and having a front side from which the cross shaped portion extends at a substantially right angle, the cross shaped portion dividing an aligning portion of the flat surface into four regions, each of the four regions having a unique identifying attribute, all the identifying attributes are only seen when viewed from a position aligned longitudinally with the elongated cross shaped portion.

14. The tool of claim 1 wherein the block is constructed from a material selected from the group consisting essentially of glass, plastic, rubber, wood, metal, cement board, and any combination thereof.

15. A tool used in fitting a shotgun to a user, the tool comprising a casing and an elongated cross shaped portion extending therefrom, the casing having a back side and having a front side from which the cross shaped portion extends at a substantially right angle, the back side has a light allowing portion that allows light to enter inside the casing, the inside of the casing having optical fibers which transmit light entering the casing to identifying attributes in the aligning portion of the flat surface, the cross shaped portion dividing the aligning portion of the flat surface into four regions, each of the four regions constructed and arranged to contain at least one of the identifying attributes, all the identifying attributes are only seen when viewed from a position aligned longitudinally with the elongated cross shaped portion.

16. The tool of claim 15 having attachment area to help secure the tool to the shotgun, the attachment area being a magnetic portion on the casing that affixes to the end of the barrel.

17. The tool of claim 15 wherein the aligning portion of the flat portion is substantially elliptical.

18. The tool of claim 15 wherein each of the identifying attributes is a different colored light.

19. The tool of claim 15 wherein the light allowing portion is constructed from a material selected from the group consisting of glass, plastic, paper, and any combination thereof.

20. The tool of claim 15 wherein the elongated cross shaped portion is constructed and arranged of a material that is non-reflective.

* * * * *